US011150577B1

(12) United States Patent
Togu et al.

(10) Patent No.: US 11,150,577 B1
(45) Date of Patent: Oct. 19, 2021

(54) DETACHABLE CONTAINER AND CONTAINER MOUNTING APPARATUS USING THE SAME

(71) Applicant: FUJIFILM BUSINESS INNOVATION CORP., Tokyo (JP)

(72) Inventors: Iori Togu, Kanagawa (JP); Yoshiyuki Takashima, Kanagawa (JP); Kiyohito Horii, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/983,444

(22) Filed: Aug. 3, 2020

(30) Foreign Application Priority Data

Mar. 25, 2020 (JP) ..... JP2020-054309

(51) Int. Cl.
*G03G 15/08* (2006.01)
*G03G 21/12* (2006.01)

(52) U.S. Cl.
CPC ..... *G03G 15/0886* (2013.01); *G03G 15/0875* (2013.01); *G03G 21/12* (2013.01); *G03G 2215/068* (2013.01)

(58) Field of Classification Search
CPC ..... G03G 15/0875; G03G 15/0886; G03G 21/12; G03G 2215/068
See application file for complete search history.

(56) References Cited

U.S. PATENT DOCUMENTS 5,425,481 A * 6/1995 Makie ..... G03G 15/0875 222/160
5,614,996 A * 3/1997 Tanda ..... G03G 21/12 141/363
10,474,093 B1 * 11/2019 Amann ..... G03G 21/1676
2005/0147428 A1 * 7/2005 Yamada ..... G03G 15/0868 399/106
2008/0069587 A1 * 3/2008 Keefe ..... G03G 21/1661 399/115
2008/0175629 A1 7/2008 Eto et al.
2008/0260421 A1 * 10/2008 Mase ..... G03G 21/1832 399/114
2010/0215407 A1 * 8/2010 Funada ..... G03G 21/1623 399/258

(Continued)

FOREIGN PATENT DOCUMENTS

JP 2008-203830 A 9/2008

*Primary Examiner* — David J Bolduc
(74) *Attorney, Agent, or Firm* — Oliff PLC

(57) ABSTRACT

A detachable container includes: a container body; and operation units on both sides of the container body attaching and detaching the container body. Each operation unit includes an outer gripping unit at an outer side of a respective one of both side walls of the container body, an inner gripping unit at an inner side of the respective one of both side walls of the container body in the width direction in an attachment and detachment operation side surface of the container body, and a cover projecting in an eave shape laterally from a respective one of both sides of the attachment and detachment operation side surface of the container body in the width direction, the cover covering the gap between the respective one of both side walls of the container body and a projecting end of the outer gripping unit when viewed from the attachment and detachment operation side.

20 Claims, 12 Drawing Sheets

(56) References Cited

U.S. PATENT DOCUMENTS

| | | | | |
|---|---|---|---|---|
| 2010/0247137 | A1* | 9/2010 | Akaike | G03G 21/12 399/110 |
| 2010/0266310 | A1* | 10/2010 | Saiki | G03G 21/1821 399/102 |
| 2010/0322666 | A1* | 12/2010 | Inomata | G03G 15/0886 399/120 |
| 2011/0243613 | A1* | 10/2011 | Kawamura | G03G 21/1676 399/258 |
| 2012/0076548 | A1* | 3/2012 | Ninomiya | G03G 15/0875 399/262 |
| 2012/0163858 | A1* | 6/2012 | Fuju | G03G 21/1842 399/110 |
| 2013/0078004 | A1* | 3/2013 | Matsumoto | G03G 15/0886 399/260 |
| 2013/0101317 | A1* | 4/2013 | Shimizu | G03G 15/0879 399/258 |
| 2014/0140735 | A1* | 5/2014 | Oda | G03G 15/0875 399/258 |
| 2015/0139688 | A1* | 5/2015 | Leemhuis | G03G 21/1676 399/110 |
| 2020/0096938 | A1* | 3/2020 | Endo | G03G 21/1647 |

* cited by examiner

DETACHABLE CONTAINER AND CONTAINER MOUNTING APPARATUS USING THE SAME

CROSS-REFERENCE TO RELATED APPLICATIONS

This application is based on and claims priority under 35 USC 119 from Japanese Patent Application No. 2020-054309 filed Mar. 25, 2020.

BACKGROUND

1. Technical Field

The present disclosure relates to a detachable container and a container mounting apparatus using the same.

2. Related Art

In the related art, a detachable container described in JP-A-2008-203830 (see the "detailed description of the invention" section and FIG. 5) is known.

JP-A-2008-203830 discloses a toner container that is freely detachably mounted into an apparatus body of a printer in order to replenish a developing device provided in the printer with toner. The toner container includes a container which is long in one direction and is filled with toner therein. The container has a handle recess that is gripped when the container is attached to or detached from the apparatus body. The handle recess is provided relatively closer to the side of the container opposite in the left-and-right direction to the side thereof provided with an engagement projection for preventing the uplifting of the container.

SUMMARY

Aspects of non-limiting embodiments of the present disclosure relate to preventing a detachable container from being accidentally dropped due to a wrong operation when the detachable container with the heavy weight is detached or attached while holding operation units provided in both sides of a container body in a width direction intersecting an attachment and detachment direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a detachable container includes: a container body that is attachable to and detachable from a receiving portion of an apparatus housing; and operation units provided on both sides of the container body in a width direction intersecting an attachment and detachment direction, the operation units that perform an operate of attaching and detaching the container body. Each of the operation units includes an outer gripping unit that is provided at an outer side of a respective one of both side walls of the container body in the width direction, the outer gripping unit extending toward an attachment and detachment operation side of the container body from a back side of the container body, the outer gripping unit being elastically deformable via a gap between the outer gripping unit and the container body, an engagement unit that is provided on a portion of the outer gripping unit, the engagement unit being detachably engaged with an engaged portion provided in the receiving portion of the apparatus housing, an inner gripping unit that is provided at an inner side of the respective one of both side walls of the container body in the width direction in an attachment and detachment operation side surface of the container body, the inner gripping unit being able to be gripped together with the outer gripping unit, and a cover that projects in an eave shape laterally from a respective one of both sides of the attachment and detachment operation side surface of the container body in the width direction, the cover covering the gap between the respective one of both side walls of the container body in the width direction and a projecting end of the outer gripping unit when viewed from the attachment and detachment operation side.

BRIEF DESCRIPTION OF THE DRAWINGS

Exemplary embodiment(s) of the present disclosure will be described in detail based on the following figures, wherein.

DETAILED DESCRIPTION

Outline of Exemplary Embodiment

Figure 1A:
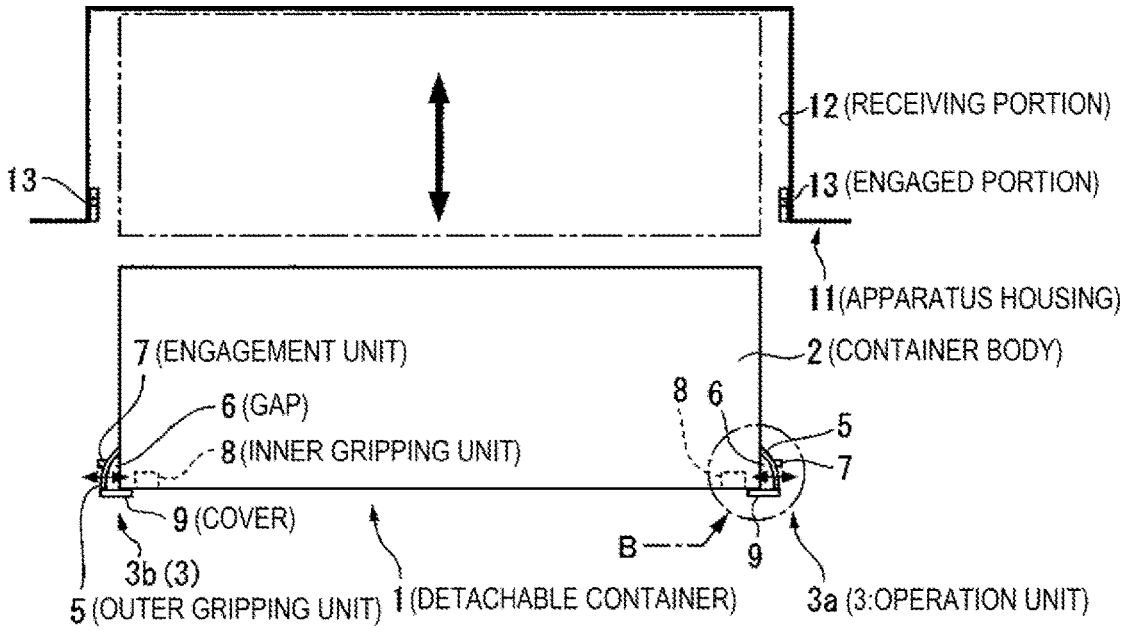
FIG. 1A is a view illustrating an outline of an exemplary embodiment of a container mounting apparatus including a detachable container to which the present disclosure is applied.

FIG. 1A is a view illustrating an outline of an exemplary embodiment of a container mounting apparatus including a detachable container to which the present disclosure is applied.

In FIG. 1A, the container mounting apparatus includes an apparatus housing 11 and a detachable container 1 that is detachably mounted in a receiving portion 12 of the apparatus housing 11.

Figure 1B:
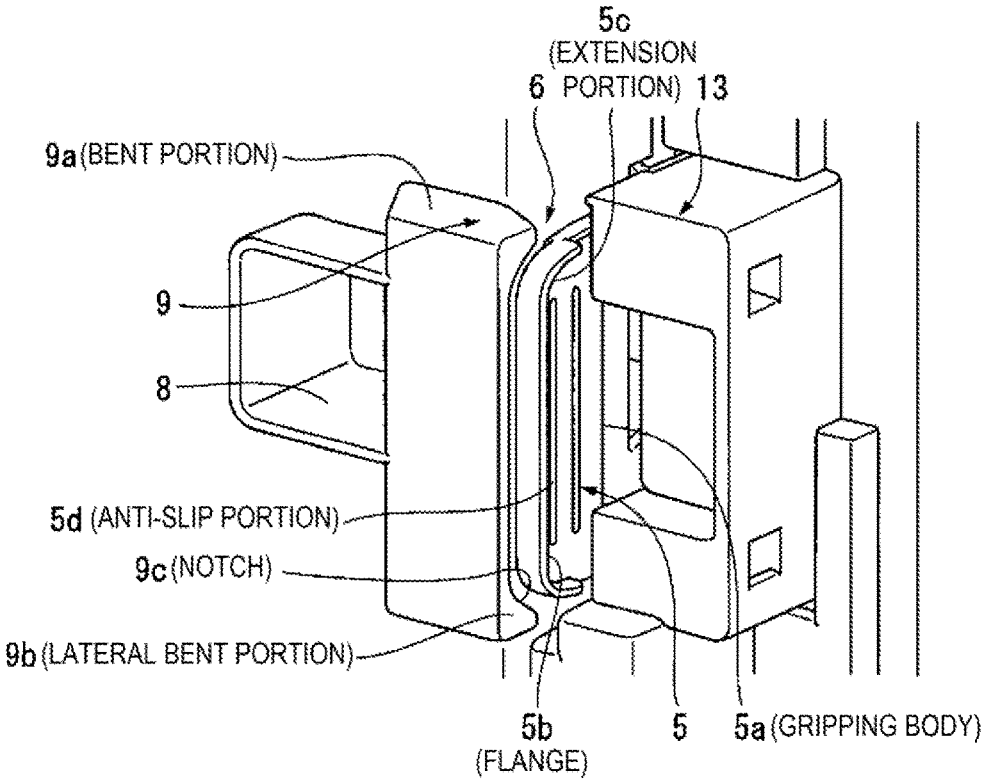
FIG. 1B is a view specifically illustrating a portion B of the detachable container illustrated in FIG. 1A.

In this example, the detachable container 1 includes a container body 2 that is attachable to and detachable from the receiving portion 12 of the apparatus housing 11, and operation units 3 (specifically, 3*a* and 3*b*) that are provided on both sides of the container body 2 in a width direction intersecting an attachment and detachment direction and perform an operation of attaching and detaching the container body 2. As illustrated in FIGS. 1A and 1B, each of the operation units 3 (3*a* and 3*b*) includes: an outer gripping unit 5 that is provided at an outer side of a respective one of both side walls of the container body 2 in the width direction, extends toward an attachment and detachment operation side of the container body 2 from a back side of the container body 2, and is elastically deformable via a gap 6 between the outer gripping unit 5 and the container body 2; an engagement unit 7 that is provided at a portion of the outer gripping unit 5 and is detachably engaged with an engaged portion 13 provided in the receiving portion 12 of the apparatus housing 11; an inner gripping unit 8 that is provided at an inner side of each of both side walls of the container body 2 in the width direction in an attachment and detachment side surface of the container body 2, and can be gripped together with the outer gripping unit 5; and a cover 9 that projects in an eave shape laterally from each of both sides of the attachment and detachment operation side surface of the container body 2 in the width direction, and covers the gap 6 between each of both side walls of the container body 2 in the width direction and a projecting end of the outer gripping unit 5 when viewed from the attachment and detachment operation side.

With these technical units, the detachable container 1 of the present disclosure includes a broad scope of a detachable container that accommodates a liquid or solid accommodation target, without being limited to powder such as waste toner or the like.

It is presumed that the operation units 3 are provided on both sides of the container body 2 in the width direction intersecting the attachment and detachment direction. The two operation units 3 is not limited to ones having the same positional relationships in a vertical direction. The two operation units 3 may have different positional relationships in the vertical direction.

Further, it is presumed that the outer gripping unit 5 implements a so-called snap-fit action, and the outer gripping unit 5 has a structure in which the engagement unit 7 (for example, a protrusion) is detachable from the engaged portion 13 (for example, a hole) provided in the receiving portion 12 of the apparatus housing 11 such that the container body 2 is attached to/detached from the receiving portion 12 of the apparatus housing 11.

Further, the inner gripping unit 8 includes a broad scope of a gripping unit that may be gripped together with the outer gripping unit 5, without being limited to a recess. Accordingly, instead of a recess, a projecting member having the gripping function may be provided. Then, the cover 9 may be disposed closer to the attachment and detachment operation side than the inner gripping unit 8, in order to prevent an operator from gripping only the projecting member.

Further, the cover 9 includes a broad scope of an aspect where the cover 9 covers the gap 6 between each of both side walls of the container body 2 in the width direction and the projecting end of the outer gripping unit 5 when viewed from the attachment and detachment operation side. For example, the cover 9 and the projecting end of the outer gripping unit 5 may not overlap with each other, and the gap 6 between the cover 9 and the projecting end of the outer gripping unit 5 may be secured to be relatively wide.

Meanwhile, while the attachment and detachment operation by the operation unit 3 is necessary for the attachment and detachment of the detachable container 1, a restraining unit (not illustrated in FIG. 1A and FIG. 1B) may be provided such that the detachable container 1 is restrained not to be detached when the detachable container 1 is mounted in the receiving portion 12 of the apparatus housing 11, and becomes detachable when the restraining unit is released, from the viewpoint of stably mounting the detachable container 1 in the receiving portion 12 of the apparatus housing 11.

Next, a representative aspect of the detachable container 1 according to the present exemplary embodiment will be described.

First, as an aspect of the cover 9, the cover 9 may have an overlapping portion that faces the projecting end of the outer gripping unit 5 when viewed from the attachment and detachment operation side of the container body 2. This example is effective in that when the operator attempts to grip only the outer gripping unit 5, the overlapping portion interferes the gripping behavior, and thereby, making it difficult to grip only the outer gripping unit 5.

Further, as another aspect of the cover 9, the projecting end of the outer gripping unit 5 may be exposed laterally from the cover 9 when viewed from the attachment and detachment operation side of the container body 2. This example is intended to avoid that the outer gripping unit 5 is entirely hidden by the cover 9 when viewed from the attachment and detachment operation side. The presence of the outer gripping unit 5 may be visually recognized when viewed from the attachment and detachment operation side. The operator may easily see the position of the operation unit 3.

Further, as yet another aspect of the cover 9, a minute gap of 1 mm or less may be formed between the cover 9 and the projecting end of the outer gripping unit 5. This example is intended to secure the minute gap of 1 mm or less so as to prevent a long finger nail of the operator from squeezing into the gap, in consideration of the concern that the long finger nail of the operator may squeeze into the gap when the operator attempts to grip only the outer gripping unit 5.

Further, as yet another aspect of the cover 9, the vertical width dimension of the cover 9 may be longer than the vertical width dimension of the outer gripping unit 5. In this example, the vertical width dimension of the cover 9 is made longer than that of the outer gripping unit 5, so that the cover 9 prevents the operator from attempting to grip only the outer gripping unit 5 from an obliquely upward direction or from an obliquely downward direction.

Further, as yet another aspect of the cover 9, the cover 9 may have bent portions 9*a* that are bent toward the gap 6 between each of both side walls of the container body 2 in the width direction and the outer gripping unit 5, at the upper and lower ends thereof. In this example, the bent portions 9*a* cover the upper and lower gaps between the cover 9 and the outer gripping unit 5, so that there is little concern that the operator grips only the upper and lower portions of the outer gripping unit 5.

Further, as yet another aspect of the cover 9, each cover 9 may have a lateral bent portion 9*b* at the projecting end of the cover 9. The bent portion 9*b* is bent toward the gap 6. The projecting end of each cover 9 extends laterally from the respective one of both side walls of the container body 2 in the width direction. The lateral bent portion 9*b* has a notch 9*c* that follows the shape of the projecting end of the outer gripping unit 5. In this example, the lateral gap between the cover 9 and the outer gripping unit 5 is blocked, so that the thumb or the finger nail of the operator hardly squeezes into the lateral gap.

Next, as an aspect of the outer gripping unit 5, the outer gripping unit 5 may have a flange 5*b* that is bent outward, at the projecting end of a gripping body 5*a*. In this example, the flange 5*b* comes into contact with the finger pads of the operator, and thereby, preventing the fingers of the operator from sliding on the outer gripping unit 5.

Further, in this example, the flange 5*b* may have extension portions 5*c* that extend toward the gripping body 5*a*, at the upper and lower ends thereof, and it is possible to make it difficult to grip the outer gripping unit 5 even from the vertical direction, as compared with a case where the extension portions 5*c* are not provided.

Further, as another aspect of the outer gripping unit 5, the outer gripping unit 5 may have anti-slip portions 5*d* on the outer surface of the gripping body 5*a*.

Further, as an aspect of the inner gripping unit 8, a recess may be formed in the attachment and detachment operation side surface of the container body 2. In this example, the thumb of the operator is easily caught.

Here, as an aspect of the recess which serves as the inner gripping unit 8, the recess may have the vertical width dimension shorter than the vertical width dimension of the outer gripping unit 5, and may be biased to the vicinity of the upper portion of the outer gripping unit 5. In this example, the layout that matches the arrangement of the fingers of the operator may be implemented.

Further, the recess which serves as the inner gripping unit 8 may have a hollow (not illustrated in FIG. 1A and FIG. 1B) in the inner wall thereof close to the outer gripping unit 5, from the viewpoint of relatively effectively holding the thumb catching performance.

Hereinafter, the present disclosure will be described in more detail, based on the exemplary embodiments illustrated in the accompanying drawings.

Exemplary Embodiment 1

Figure 2:
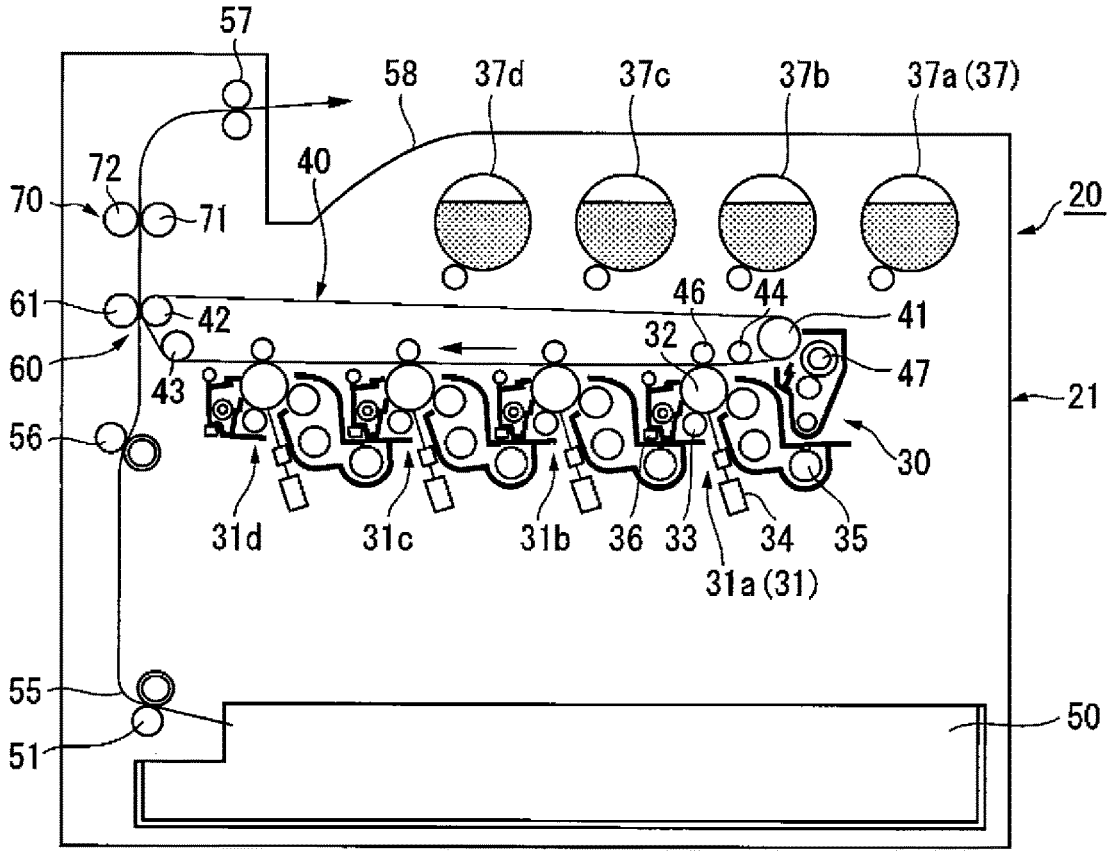
FIG. 2 is a view illustrating an entire configuration of an image forming apparatus which is an example of a container mounting apparatus according to Exemplary Embodiment 1.

FIG. 2 is a view illustrating an entire configuration of an image forming apparatus which is an example of a container mounting apparatus according to Exemplary Embodiment 1.

—Entire Configuration of Image Forming Apparatus—

In an image forming apparatus 20 illustrated in FIG. 2, an image forming engine 30 is mounted inside an apparatus housing 21 to form, for example, plural color component images, a sheet supply container 50 (a single-stage configuration in this example) is disposed below the image forming engine 30 to supply a sheet as a medium, the sheet supplied from the sheet supply container 50 is transported through a transport path 55 that extends substantially vertically, images that are formed in the image forming engine 30, transferred onto a collective transfer device 60, and then, transferred onto the sheet are fixed by a fixing device 70, and the sheet onto which the images have been fixed is ejected to a sheet ejection tray 58 provided, for example, on the top of the apparatus housing 21.

—Image Forming Engine—

In this example, the image forming engine 30 includes plural image forming units 31 (specifically, 31*a* to 31*d*) provided with plural color component (yellow (Y), magenta (M), cyan (C), and black (K)) toners and adopting an electrophotographic method, and is configured such that color component images formed in the image forming units 31, respectively, are primarily transferred onto an intermediate transfer body 40, and then, the images on the intermediate transfer body 40 are collectively transferred by the collective transfer device 60 onto the sheet.

<Image Forming Unit>

In this example, each image forming unit 31 (31*a* to 31*d*) includes, for example, a drum-shaped photoconductor 32, and a charging device 33, a latent image writing device 34, a developing device 35, and a cleaning device 36 are arranged around the photoconductor 32. The charging device 33 charges the photoconductor 32, the latent image writing device 34 forms an electrostatic latent image on the charged photoconductor 32, the developing device 35 develops the electrostatic latent image formed on the photoconductor 32 with the color component toners, and the cleaning device 36 cleans toner remaining on the photoconductor 32 after the primary transfer onto the intermediate transfer body 40.

In this example, the charging device 33 is a charging roller that charges the photoconductor 32 in a contact manner, or a corotron, a scorotron or the like that charges the photoconductor 32 in a non-contact manner.

Further, while the latent image writing device 34 is a device that separately writes a latent image using, for example, an LED array for each image forming unit 31, the latent image writing device 34 is not limited thereto. A common laser scanning device may write an electrostatic latent image of each color component using a corresponding laser light for each image forming unit 31, or a laser scanning device may be separately provided for each image forming unit 31.

Further, the developing device 35 is a developing device in which, for example, a two-component developer including a toner and a carrier is used, a developing roller is disposed inside a developing container, and for example, plural agitation transport members are arranged inside the developing container to charge the developer while agitating and mixing the developer. However, the developing device 35 is not limited thereto, and may be appropriately selected.

Further, the cleaning device 36 is a cleaning member appropriately selected from a cleaning blade, a cleaning brush and a cleaning roller for scraping off toner remaining on the photoconductor 32.

Meanwhile, the reference numeral 37 (specifically, 37*a* to 37*d*) refers to a toner cartridge that replenishes each color component toner to the developing device 35 of each image forming unit 31 (31*a* to 31*d*).

<Intermediate Transfer Body>

Further, in this example, the intermediate transfer body 40 is implemented by, for example, a belt-shaped member that stretches over plural tension rollers 41 to 44. The intermediate transfer body 40 is driven to be circularly movable in a predetermined direction by using, for example, the tension roller 41 as a driving roller, and the tension roller 43 functions as a tension applying roller that applies a desired tension to the intermediate transfer body 40.

Further, a primary transfer device 46 (for example, a primary transfer roller) is provided on the back surface of the intermediate transfer body 40 that faces the photoconductor 32 of each image forming unit 31, and is configured to primarily transfer an image on the photoconductor 32 onto the intermediate transfer body 40 by forming a primary transfer electric field between the primary transfer device 46 and the photoconductor 32.

Meanwhile, the reference numeral 47 refers to a cleaning device for an intermediate transfer body. The cleaning device 47 is provided at a portion of the intermediate transfer body 40 that faces the tension roller 41. The cleaning device 47 cleans residues (for example, toner or paper dust) on the intermediate transfer body 40.

—Collective Transfer Device—

In the present exemplary embodiment, the collective transfer device 60 is basically configured such that a transfer roller 61 faces the tension roller 42 of the intermediate transfer body 40, the transfer roller 61 is, for example, grounded, a transfer voltage is applied from a transfer power supply (not illustrated) to the tension roller 42, and a transfer electric field is formed in a transfer region between the intermediate transfer body 40 and the transfer roller 61, so as to secondarily transfer an image on the intermediate transfer body 40 onto the sheet passing through the transfer region.

—Fixing Device—

Further, in the present exemplary embodiment, the fixing device 70 includes a rotatable heating fixing member (a heating fixing roller in this example) 71 of which surface temperature is heated to a predetermined temperature by a heater serving as a heating source, and a pressurizing fixing member (a pressurizing fixing roller in this example) 72 that rolls in contact with the heating fixing member 71 with a predetermined contact pressure along the axial direction of the heating fixing member 71. By causing the sheet which carries an unfixed image thereon to pass through the contact region between the two fixing members 71 and 72, the unfixed image is fixed.

—Sheet Transport System—

In the present exemplary embodiment, a sheet transport system is configured such that the sheet is delivered from a feeder 51 of the sheet supply container 50 to the transport path 55, the positioning of the sheet is performed by a positioning roller 56 provided at an upstream portion of the transport path 55 in the transport direction of the sheet from the batch transfer region of the collective transfer device 60, the transfer process is performed by the collective transfer device 60, the sheet that has been subjected to the fixing process by the fixing device 70 is ejected by an ejection roller 57 toward the sheet discharge tray 58 formed on the top of the apparatus housing 21. Meanwhile, an appropriate number of transport members (transport rollers) may be provided in the transport path 55 as necessary. Further, when a duplex image forming mode is executed, a duplex transport unit (not illustrated) may be added.

—Waste Developer Transport Unit—

Figure 3:
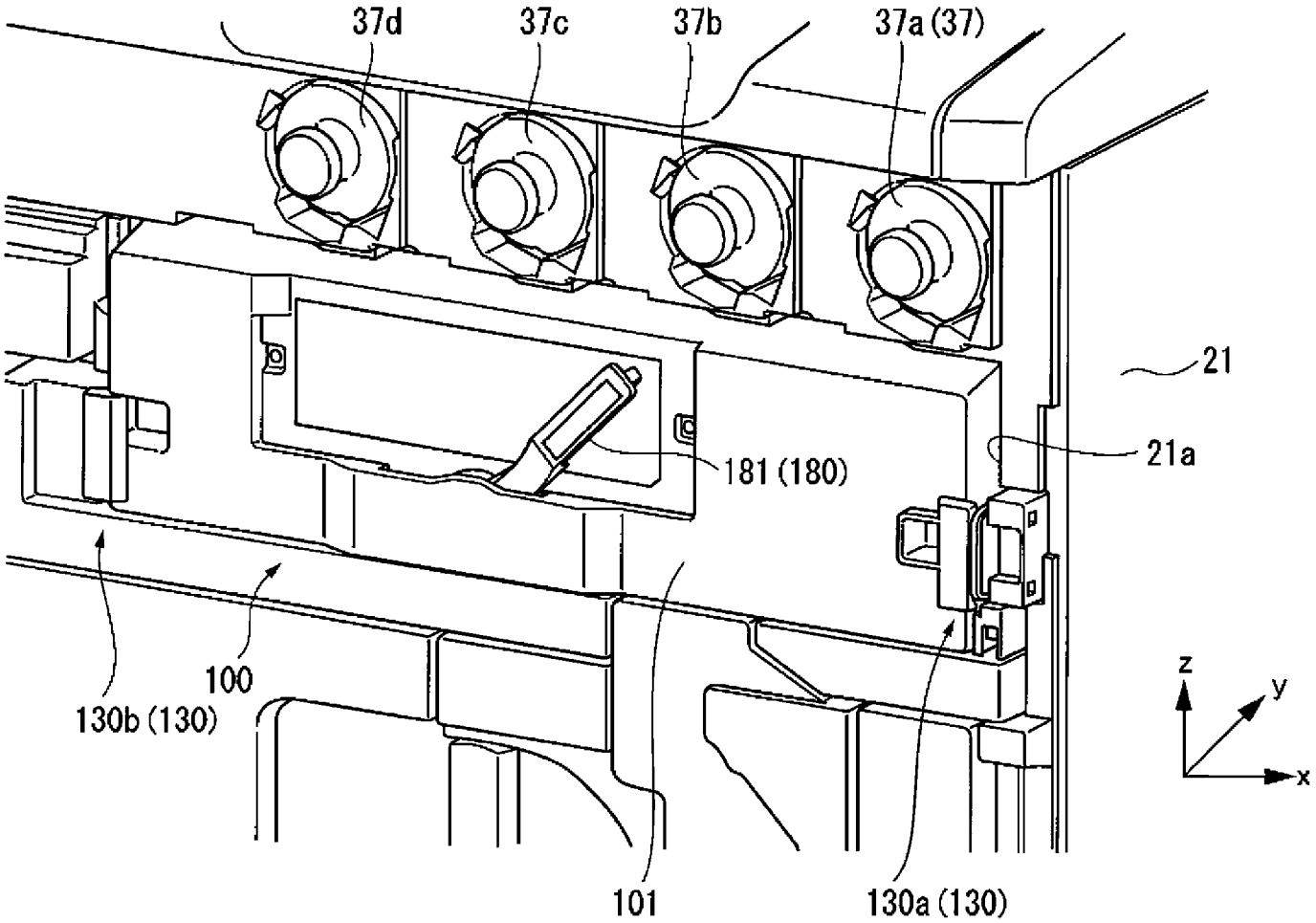
FIG. 3 is a view illustrating the periphery of a waste toner container which is a detachable container when a front opening and closing door of an apparatus housing is opened, in the image forming apparatus according to Exemplary Embodiment 1.

In the present exemplary embodiment, as illustrated in FIGS. 2 and 3, an opening and closing door (not illustrated) is provided on the front side of the apparatus housing 21, and a waste developer transport unit 100 is provided as a detachable container on the inner side of the opening and closing door in the apparatus housing 21.

In this example, the waste developer transport unit 100 transports the following two types of waste developer. (1) The cleaning device 36 of each image forming unit 31 (31*a* to 31*d*) cleans waste toner which is a waste developer remaining on the photoconductor 32. The cleaned waste toner is primarily stored in a cleaning container, and then, is discharged from one end of the cleaning container by a transport member provided inside the cleaning container. The discharged waste toner is transported to the waste developer transport unit 100 via each of transport ducts 111 to 114 (see FIG. 5), and is recovered into a waste developer recovery box (not illustrated). (2) While the developing device 35 of each image forming unit 31 (31*a* to 31*d*) consumes the toner of the two-component developer, the carrier remains without being consumed. Thus, when the carrier becomes old, the charging characteristics of the developer may be deteriorated. Accordingly, in this example, the waste carrier which is the old developer (waste developer) is periodically discarded from the developing container to the outside, is then transported to the waste developer transport unit 100 via each of the transport ducts 116 to 119 (see FIG. 5), and is recovered into a waste developer recovery box (not illustrated).

—Example of Configuration of Waste Developer Transport Unit—

Figure 4:
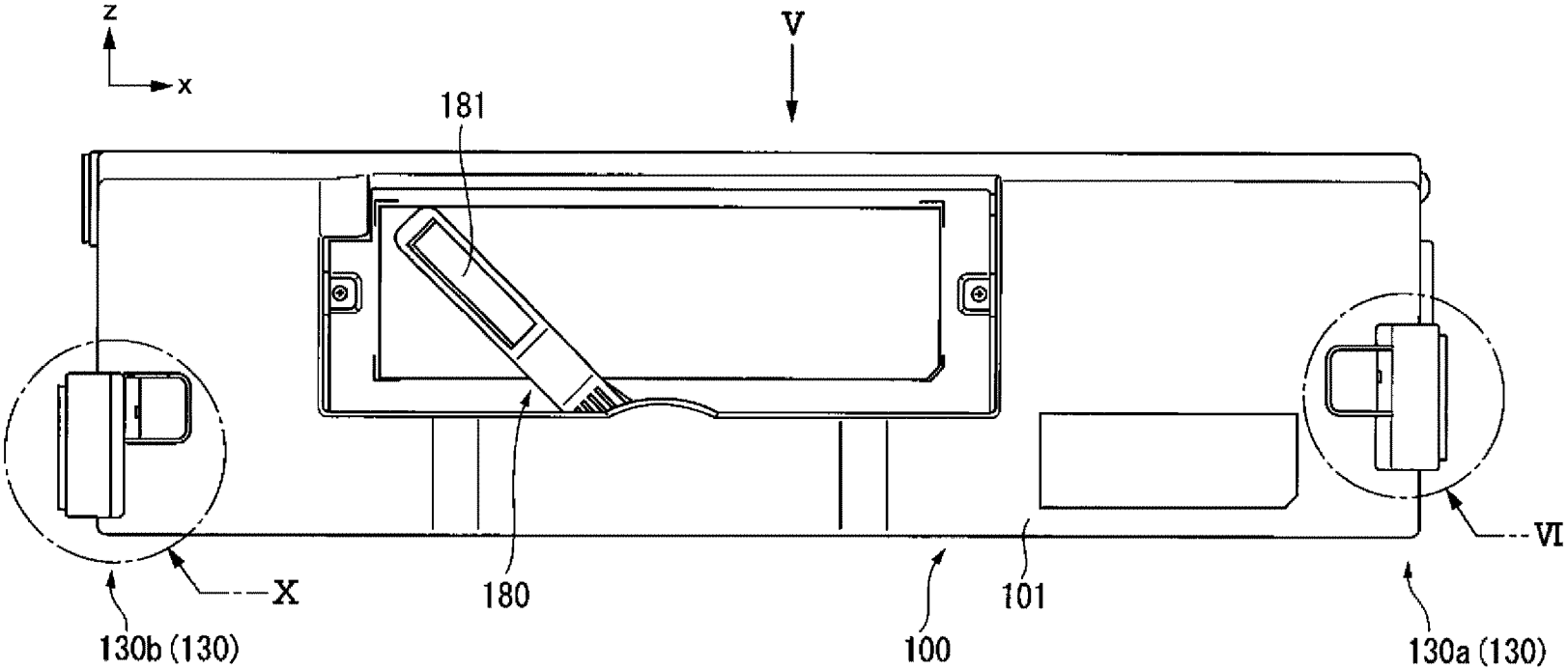
FIG. 4 is a view of the waste toner container according to Exemplary Embodiment 1 when viewed from the front side.
Figure 5:
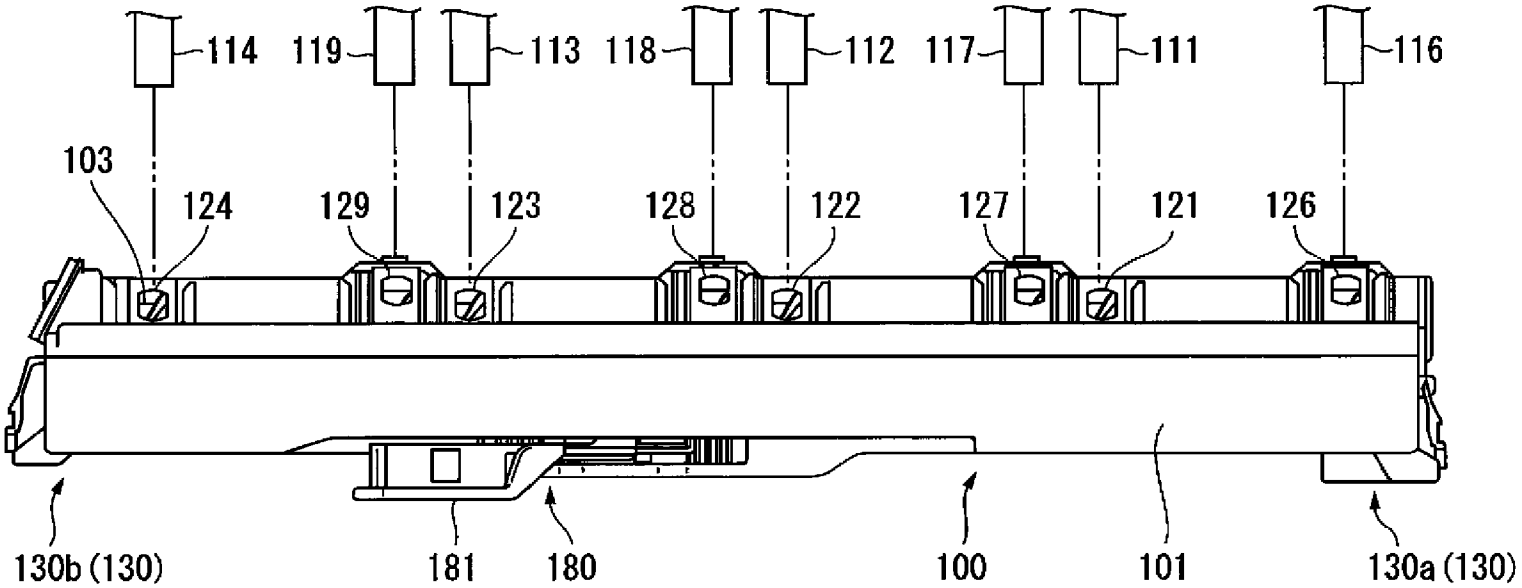
FIG. 5 is a view of the waste toner container when viewed in the direction of the arrow V in FIG. 4.
Figure 6:
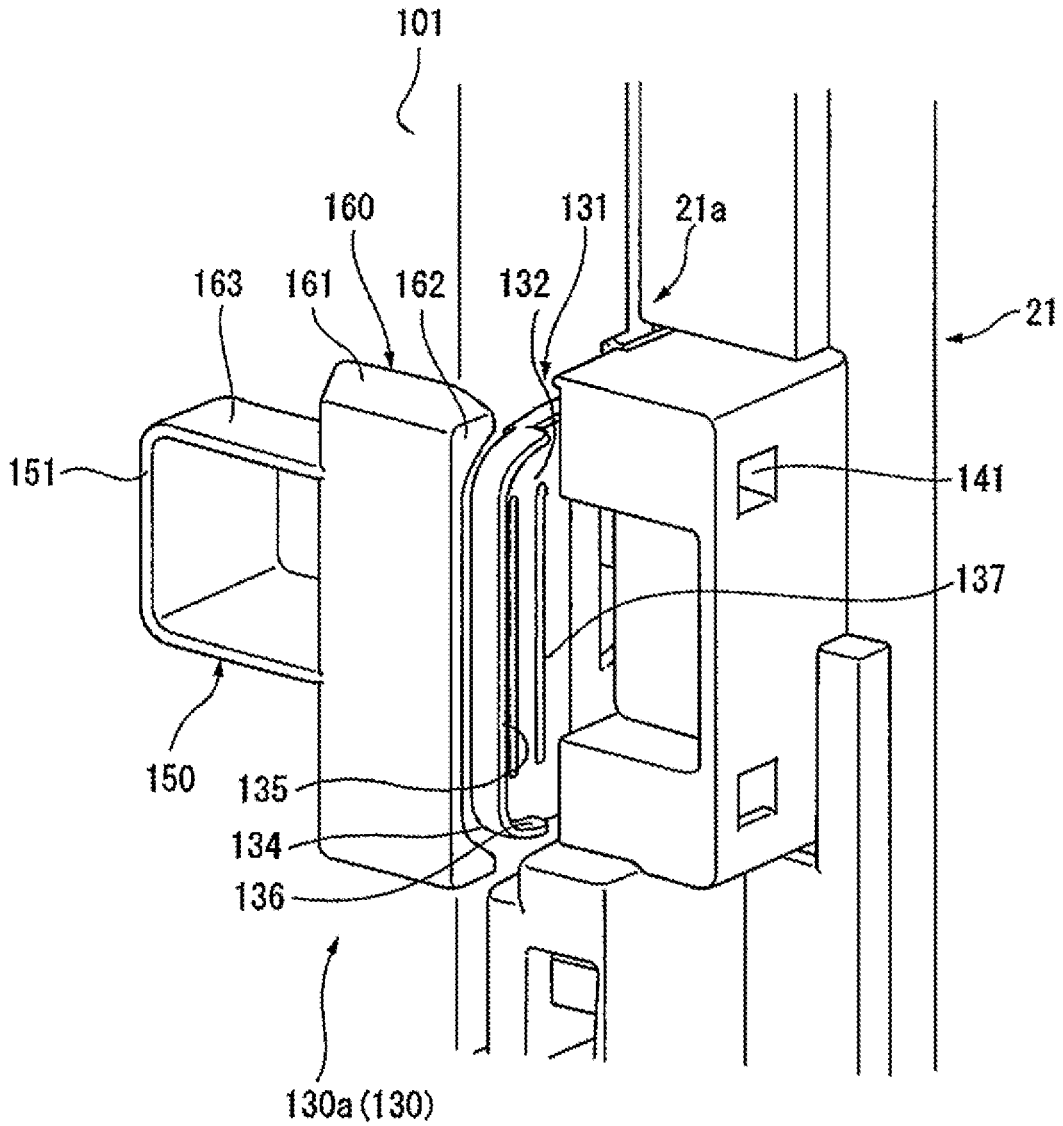
FIG. 6 is an enlarged view of the portion VI in FIG. 4.

In this example, as illustrated in FIGS. 3 to 5, the waste developer transport unit 100 includes a unit housing 101 which is a container body attached to/detached from a receiving portion 21*a* of the apparatus housing 21. The unit housing 101 has a substantially rectangular parallelepiped shape which is long in the width direction (corresponding to the direction of the arrow "x" in FIG. 3) intersecting the attachment and detachment direction (corresponding to the direction of the arrow "y" in FIG. 3). A passage forming member (not illustrated) is disposed along the width direction inside the unit housing 101 to receive the waste developer (for example, waste toner or a waste carrier), and a transport member 103 is disposed in the passage forming member (for example, an aspect where a spiral blade member is provided around a rotating shaft).

Further, operation handles 130 (specifically, 130*a*, 130*b*) are provided as operation units on both sides of the attachment and detachment operation side (corresponding to the front side of the apparatus housing 21) surface of the unit housing 101 in the width direction, respectively. Here, the position of each operation handle 130 (130*a*, 130*b*) may be appropriately selected according to the structure of the receiving portion 21*a* of the apparatus housing 21. In this example, the operation handles 130 are not axisymmetric with each other with respect to the center of the unit housing 101 in the width direction, but the first operation handle 130*a* (130) disposed on the right side when viewed from the attachment and detachment operation side of the unit housing 101 is biased to an upper side in the direction of the height direction arrow "z", as compared with the second operation handle 130*b* (130) disposed on the left side opposite to the right side.

Further, a restraining mechanism 180 is provided in the vicinity of substantially the center of the attachment and detachment operation side surface of the unit housing 101 in the width direction. The restraining mechanism 180 includes a restraining lever 181 that is able to swing between a predetermined restraining position and a predetermined releasing position. When the restraining lever 181 swings to the restraining position, the unit housing 101 is restrained with respect to the receiving portion 21*a* of the apparatus housing 21, and when the restraining lever 181 swings to the releasing position, the restrained state of the unit housing 101 with respect to the receiving portion 21*a* of the apparatus housing 21 is released.

Further, in the back surface of the unit housing 101 that is opposite to the attachment and detachment operation side surface, connection ports 121 to 124 are provided such that the transport ducts 111 to 114 from the cleaning devices 36 of the image forming units 31 may be connected to the connection ports 121 to 124, and connection ports 126 to 129 are provided such that the transport ducts 116 to 119 from the developing devices 35 of the image forming units 31 may be connected to the connection ports 126 to 129.

—First Operation Handle—

In this example, as illustrated in FIGS. 6 to 9, the first operation handle 130*a* (130) includes an outer gripping arm 131 that serves as an outer gripping unit provided at the outer side of the side wall of the unit housing 101 in the width direction.

<Outer Gripping Arm>

In this example, the outer gripping arm 131 is integrally formed of a synthetic resin, and has an elastic arm piece 132 which is a gripping arm body that extends toward the attachment and detachment operation side from a fixing point, that is, the back side of the side wall of the unit housing 101 in the width direction, and that is elastically deformable.

Here, the elastic arm piece 132 includes a substantially rectangular plate member disposed with a gap 133 (see FIG. 11) interposed between the elastic arm piece 132 and the side wall of the unit housing 101 in the width direction. The projecting end of the elastic arm piece 132 is disposed to project slightly from the general surface of the attachment and detachment operation side surface of the unit housing 101, and the upper and lower end corners of the elastic arm piece 132 close to the projecting end are formed as curved portions 134.

Further, in this example, a flange 135 is integrally formed at the projecting end of the elastic arm piece 132 to be bent outward, and the flange 135 has extension portions 136 that extend along the curved portions 134 of the elastic arm piece 132.

Further, plural ridges 137 are provided on the outer side surface of the elastic arm piece 132 to slightly project and extend vertically.

Figure 8B:
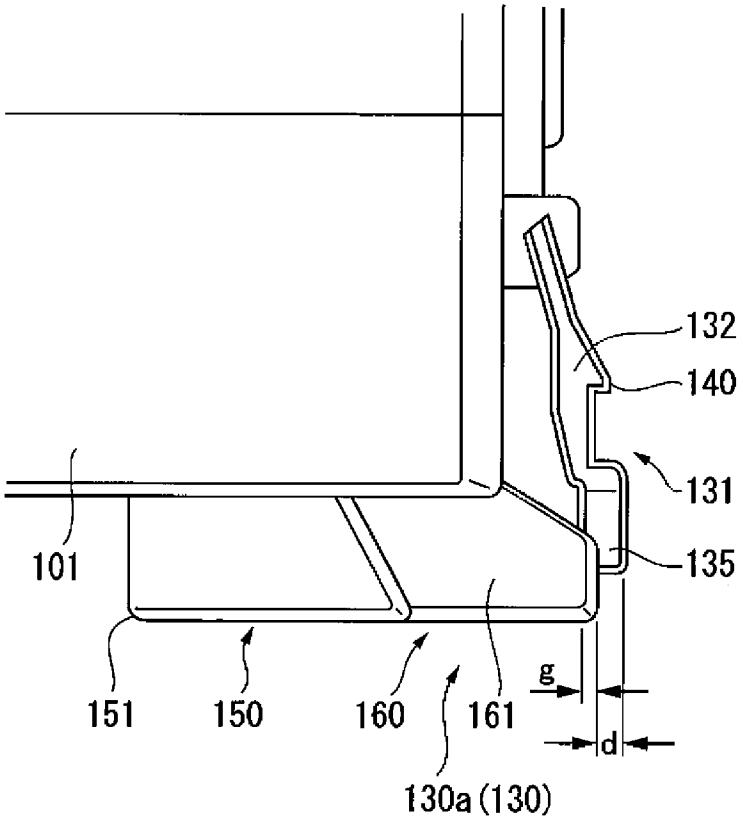
FIG. 8B is a view illustrating the operation handle when viewed in the direction of the arrow B of FIG. 8A.
Figure 8A:
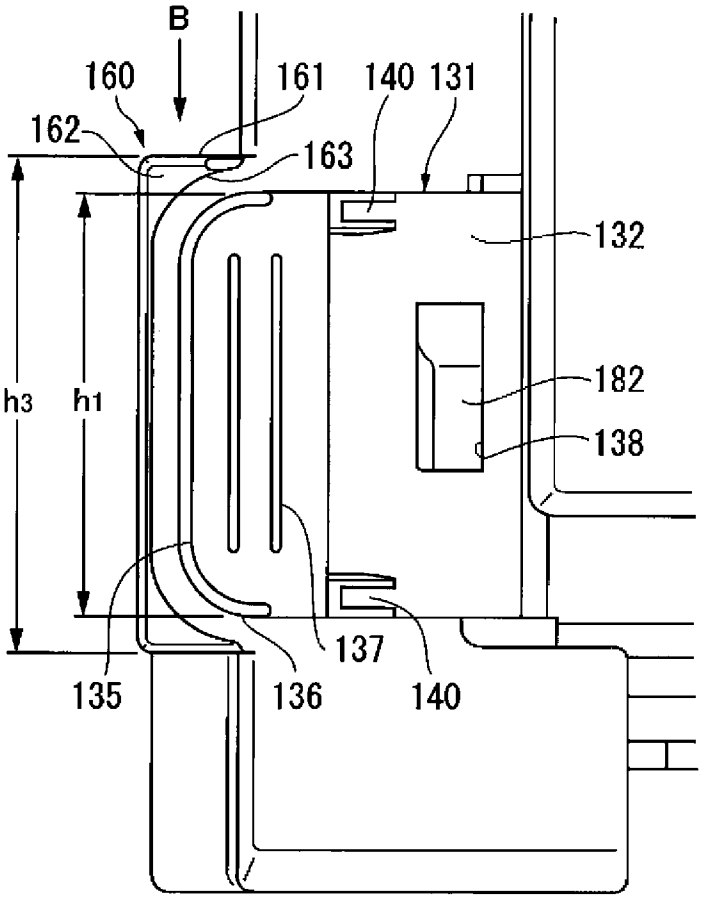
FIG. 8A is a view illustrating the operation handle when viewed in the direction of the arrow VIII of FIG. 7.
Figure 9:
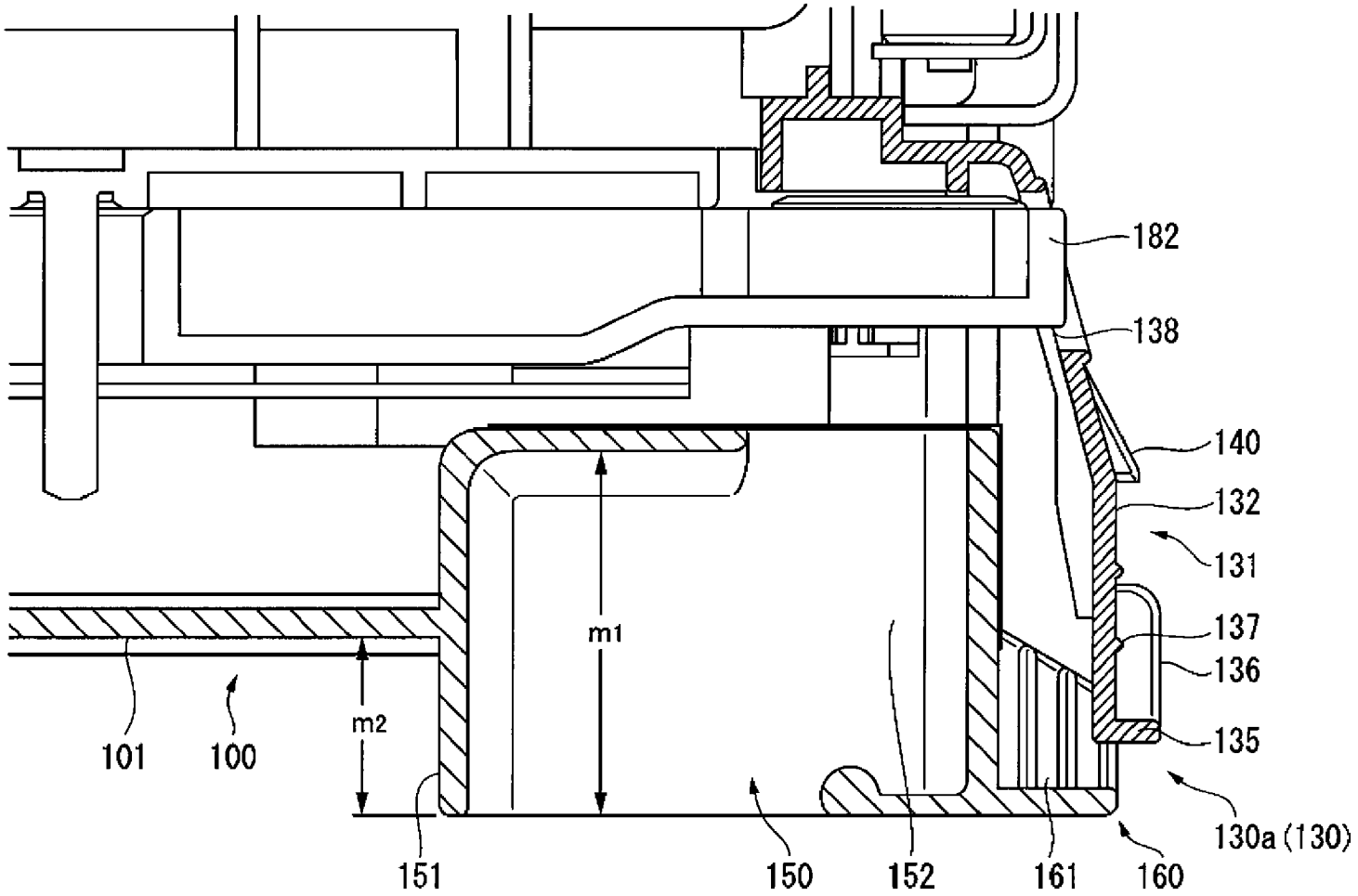
FIG. 9 is a cross-sectional view taken along the IX-IX line of FIG. 7.

Meanwhile, in FIGS. 8A and 9, the reference numeral 182 refers to an operation rod that moves forward and backward along with the restraining lever 181 of the restraining mechanism 180. A passage hole 138 is formed in the elastic arm piece 132 to allow the forward and backward movement of the operation rod 182.

<Engagement Protrusion>

In this example, since the outer gripping arm 131 includes the elastic arm piece 132 that is elastically deformable, an engagement protrusion 140 is integrally formed at a position apart from the fixing point of the elastic arm piece 132 to protrude outward with a V-shaped cross-section. Meanwhile, an engaged recess 141 serving as an engaged portion is formed at a position of the receiving portion 21*a* of the apparatus housing 21 that corresponds to the engagement protrusion 140.

Thus, in this example, when the waste developer transport unit 100 is mounted in the receiving portion 21*a* of the apparatus housing 21, the elastic arm piece 132 of the outer gripping arm 131 provided on the side wall of the unit housing 101 in the width direction moves along the receiving portion 21*a* of the apparatus housing 21 while being elastically deformed, and the engagement protrusion 140 provided on the elastic arm piece 132 is detachably engaged with the engaged recess 141 of the receiving portion 21*a* by the snap-fit action.

<Inner Gripping Recess>

In this example, the first operation handle 130*a* (130) further includes an inner gripping recess 150 as an inner gripping unit provided at the inner side of the side wall of the unit housing 101 in the width direction within the attachment and detachment operation side surface.

In this example, the inner gripping recess 150 may be gripped together with the outer gripping arm 131, and is provided to correspond to a substantially rectangular parallelepiped bulge 151 that bulges from the general surface of the attachment and detachment operation side surface of the unit housing 101.

That is, in this example, as illustrated in FIG. 9, the inner gripping recess 150 is formed to have a rectangular cross section of which depth dimension m1 is deeper than a bulge dimension m2 of the bulge 151, at the position that corresponds to the bulge 151. Further, a hollow 152 is formed in the inner wall of the inner gripping recess 150 that is close to the outer gripping arm 131.

Figure 7:
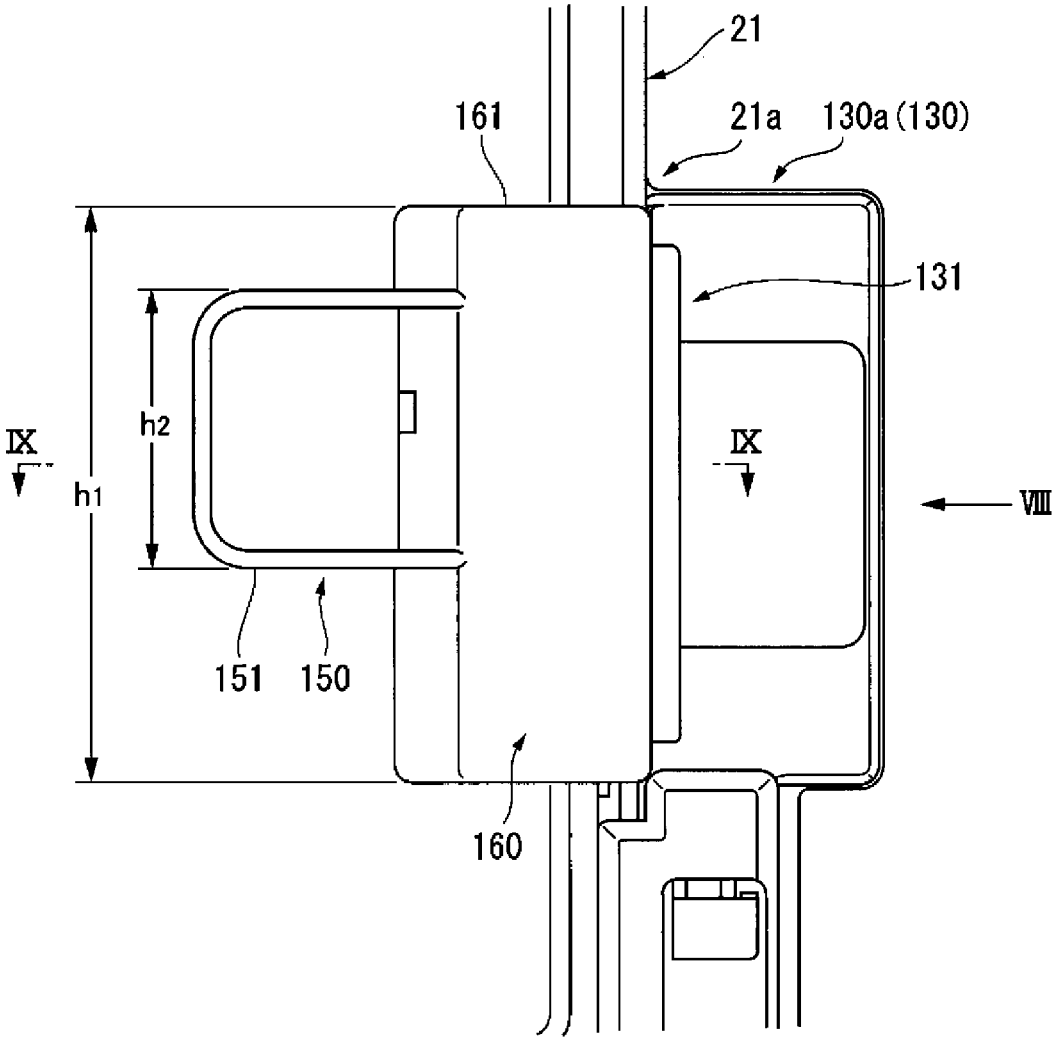
FIG. 7 is a front view of an operation handle illustrated in FIG. 6.

Further, in this example, as illustrated in FIG. 7, the inner gripping recess 150 has a vertical width dimension h2 shorter than a vertical width dimension h1 of the outer gripping arm 131, and is biased to the vicinity of the upper portion of the outer gripping arm 131. As a result, it is possible to match the layout of the outer gripping arm 131 and the inner gripping recess 150 with the arrangement of the fingers, thereby facilitating the gripping by the operator as much.

<Cover Projection Piece>

Further, in this example, a cover projection piece 160 is integrally formed as a cover that projects in an eave shape laterally from each of both sides of the attachment and detachment operation side surface of the unit housing 101 in the width direction. The cover projection piece 160 covers the gap 133 between the side wall of the unit housing 101 in the width direction and the projecting end of the outer gripping arm 131 when viewed from the attachment and detachment operation side.

In this example, as illustrated in FIG. 8A and FIG. 8B, the cover projection piece 160 has an overlapping portion "g" that faces the projecting end of the outer gripping arm 131, specifically, the flange 135 of the outer gripping arm 131, when viewed from the attachment and detachment operation side of the unit housing 101.

Further, in this example, the projecting end (the flange 135 in this example) of the outer gripping arm 131 is exposed by a dimension "d" laterally from the cover projection piece 160 when viewed from the attachment and detachment operation side of the unit housing 101.

Further, the cover projection piece 160 has a minute gap of 1 mm or less between the cover projection piece 160 and the projecting end of the outer gripping arm 131.

Further, in this example, a vertical width dimension h3 of the cover projection piece 160 is longer than the vertical width dimension h1 of the outer gripping arm 131.

Further, in this example, the cover projection piece 160 has bent portions 161 that are bent toward the gap 133 at the upper and lower ends thereof. Further, the cover projection piece 160 has a lateral bent portion 162 that is bent toward the gap 133 at the projecting end thereof that extends laterally from the side wall of the unit housing 101 in the width direction, and the lateral bent portion 162 has a notch 163 that follows the shape of the projecting end of the outer gripping arm 131.

—Second Operation Handle—

Figure 10:
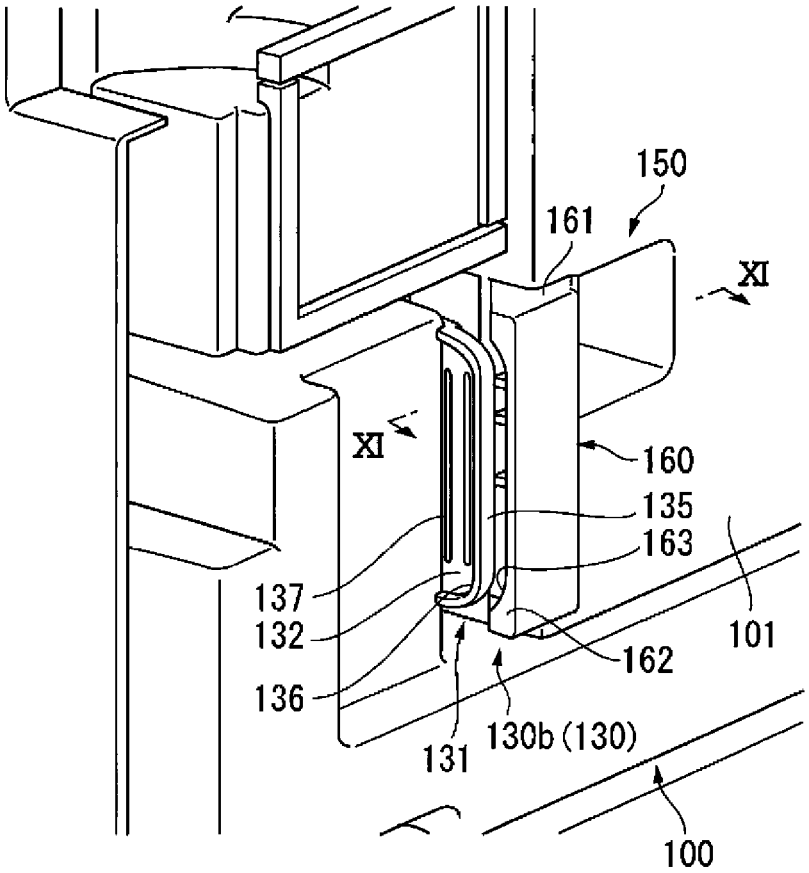
FIG. 10 is an enlarged view illustrating the portion X in FIG. 4.
Figure 11:
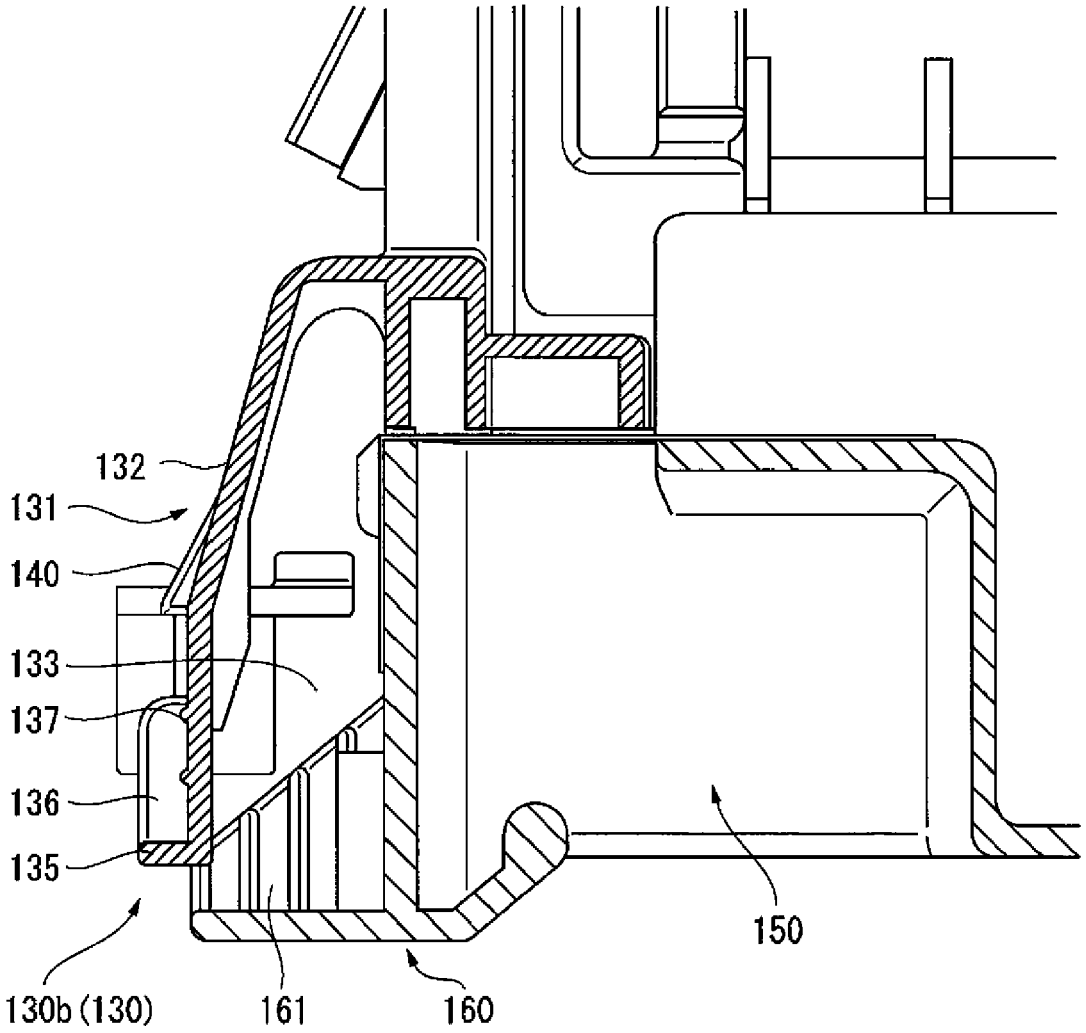
FIG. 11 is a cross-sectional view taken along the XI-XI line of FIG. 10.

In this example, as illustrated in FIGS. 10 and 11, the second operation handle 130*b* (130) basically includes the same components as those of the first operation handle 130*a* (130), that is, the outer gripping arm 131, the engagement protrusion 140, the inner gripping recess 150, and the cover projection piece 160.

However, in the second operation handle 130*b* (130), the inner gripping recess 150 has a structure that is recessed in the general surface of the unit housing 101 on the attachment and detachment operation side.

Meanwhile, the same elements as those of the first operation handle 130*a* (130) will be denoted by the same reference numerals as used for the first operation handle 130*a* (130), and detailed descriptions thereof will be omitted.

—Operation of Attaching and Detaching Waste Developer Transport Unit—

<Operation of Detaching Waste Developer Transport Unit>

It is assumed that the waste developer transport unit 100 is currently mounted in the receiving portion 21*a* of the apparatus housing 21.

In this case, in the first operation handle 130*a* and the second operation handle 130*b* of the waste developer transport unit 100, the engagement protrusion 140 provided on the outer gripping arm 131 is engaged with the engaged recess 141 provided on the receiving portion 21*a* of the apparatus housing 21 by the snap-fit action, such that the waste developer transport unit 100 is aligned and held in the receiving portion 21*a* of the apparatus housing 21.

Here, when the waste developer transport unit 100 is detached from the receiving portion 21*a* of the apparatus housing 21, the restraining lever 181 of the restraining mechanism 180 of the waste developer transport unit 100 is moved from the restraining position to the releasing position, the first operation handle 130*a* and the second operation handle 130*b* are gripped in an appropriate state, and then, the waste developer transport unit 100 may be pulled out forward from the receiving portion 21*a* of the apparatus housing 21.

At this time, as for the appropriate gripping state of the operation handles 130 (130*a*, 130*b*), the operation handles 130 may be gripped in the manner that the fingers are caught in both outer gripping arm 131 and the inner gripping recess 150, and the outer gripping arm 131 is elastically deformed toward the inner gripping recess 150.

In this state, when the outer gripping arms 131 of the first operation handle 130*a* and the second operation handle 130*b* are moved against the elastic deformation to approach the inner gripping recess 150, the engagement protrusion 140 of the outer gripping arm 131 escapes from the engaged recess 141 of the receiving portion 21*a* of the apparatus housing 21, and thus, the state where the waste developer transport unit 100 is aligned and held in the receiving portion 21*a* of the apparatus housing 21 is released.

Thus, the operator may take out the waste developer transport unit 100 by firmly gripping the two operation handles 130 (130*a*, 130*b*).

Further, in this example, since the gap 133 between the outer gripping arm 131 and the inner gripping recess 150 is covered by the cover projection piece 160, it is possible to avoid that the operator picks only the outer gripping arm 131, in the gripping operation of the operation handles 130 (130*a*, 130*b*).

Especially, in this example, the cover projection piece 160 has the overlapping portion "g" between the cover projection piece 160 and the projecting end of the outer gripping arm 131 (the flange 135 in this example), and further, the overlapping portion "g" is formed as a minute gap of 1 mm or less. Thus, it is difficult to pick only the outer gripping arm 131 from the overlapping portion "g".

Further, in this example, the cover projection piece 160 has the bent portions 161, the lateral bent portion 162, and the notch 163, and is disposed to correspond to the shape of the flange 135 of the projecting end of the outer gripping arm 131 and the extension portion 136 thereof. Thus, it is difficult to pick the outer gripping arm 131 from the attachment and detachment operation side (front side), from an obliquely upward direction, and from an obliquely downward direction.

Further, in this example, the outer gripping arm 131 has the flange 135 formed at the projecting end of the elastic arm piece 132 and the plural ridges 137 formed on the outer side of the elastic arm piece 132. Thus, when both of the outer gripping arm 131 and the inner gripping recess 150 are gripped, the flange 135 and the plural ridges 137 of the outer gripping arm 131 implement the anti-slip action. As a result, it is possible to favorably hold the state where the outer gripping arm 131 is gripped.

Further, in this example, since the hollow 152 is formed in the inner gripping recess 150, the thumb may easily caught in the inner gripping recess 150. Thus, the gripping performance of the operation handles 130 may be improved.

Accordingly, it is possible to basically avoid that the waste developer transport unit 100 is gripped by picking only the outer gripping arm 131 of each operation handle 130 (130*a*, 130*b*). Further, even when the weight of the waste developer transport unit 100 is heavy, there is no concern that the operator drops the waste developer transport unit 100 because of confusing the gripping state of the waste developer transport unit 100.

<Operation of Attaching Waste Developer Transport Unit>

Next, a case where the waste developer transport unit 100 is attached (mounted) in the receiving portion 21*a* of the apparatus housing 21 will be described.

First, the two operation handles 130 (130*a*, 130*b*) are gripped in the appropriate gripping state, the waste developer transport unit 100 is inserted into the receiving portion 21*a* of the apparatus housing 21 to reach a mounting position, and the gripping operation of the two operation handles 130 (130*a*, 130*b*) is ended. Then, the engagement protrusion 140 of the waste developer transport unit 100 is engaged with the engaged recess 141 of the receiving portion 21*a* of the apparatus housing 21, and the waste developer transport unit 100 is aligned and held in the receiving portion 21*a*. Then, the restraining lever 181 of the restraining mechanism 180 is moved from the releasing position to the restraining position.

At this time, as described above, it is difficult to conduct the wrong operation of picking only the outer gripping arm 131 when the two operation handles 130 (130*a*, 130*b*) are gripped. Thus, when the waste developer transport unit 100 is gripped, it is possible to grip the two operation handles 130 (130*a*, 130*b*) in the appropriate gripping state.

Comparative Example 1

In evaluating the performance of the operation handles 130 (130*a*, 130*b*) according to the present exemplary embodiment, operation handles 130' of a waste developer transport unit 100' according to Comparative Example 1 will be taken as an example, and a wrong operation when the operation handles 130' are gripped will be described.

Figure 12B:
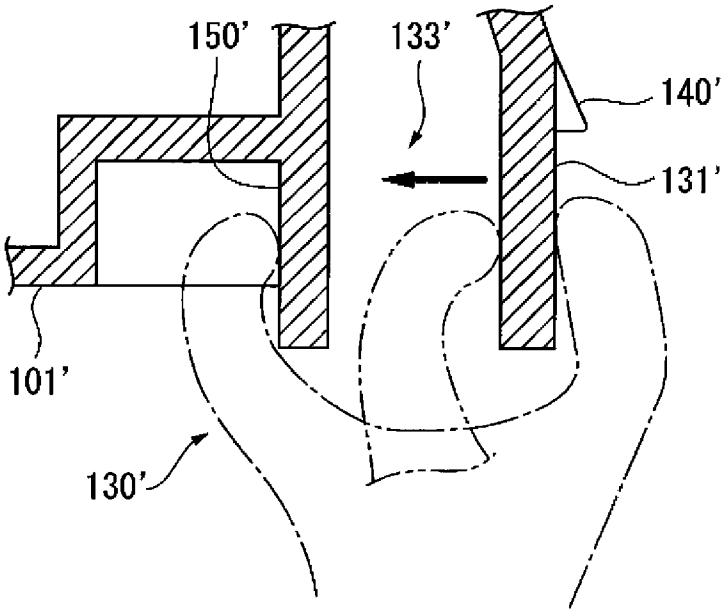
FIG. 12B is a view illustrating an example of a wrong operation of the operation handle of FIG. 12A.
Figure 12A:
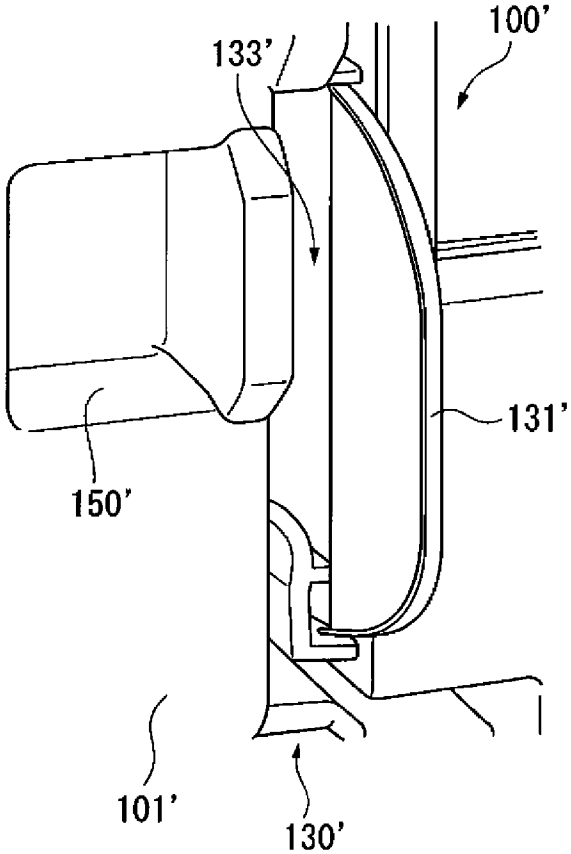
FIG. 12A is a perspective view illustrating an example of an operation handle according to Comparative Example 1.

As illustrated in FIGS. 12A and 12B, the operation handles 130' of the waste developer transport unit 100' according to Comparative Example 1 are provided on both sides of a unit housing 101' in the width direction, and each includes an outer gripping arm 131', an engagement protrusion 140', and an inner gripping recess 150'. However, since a cover projection piece is not provided as a cover, a gap 133' between the side wall of the unit housing 101' in the width direction and the outer gripping arm 131' is exposed as it is.

In the operation handle 130' of Comparative Example 1, both of the outer gripping arm 131' and the inner gripping recess 150' need to be gripped in order to stably grip the operation handle 130', as indicated by the alternate long and short dash line in FIG. 12B. However, since no cover projection piece exists, it may be understood that the wrong operation of gripping only the outer gripping arm 131' easily occurs, as indicated by the alternate long and two short dash line in FIG. 12B.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A detachable container comprising:

a container body that is attachable to and detachable from a receiving portion of an apparatus housing; and operation units provided on both sides of the container body in a width direction intersecting an attachment and detachment direction, the operation units that perform an operate of attaching and detaching the container body, wherein each of the operation units includes an outer gripping unit that is provided at an outer side of a respective one of both side walls of the container body in the width direction, the outer gripping unit extending toward an attachment and detachment operation side of the container body from a back side of the container body, the outer gripping unit being elastically deformable via a gap between the outer gripping unit and the container body, an engagement unit that is provided on a portion of the outer gripping unit, the engagement unit being detachably engaged with an engaged portion provided in the receiving portion of the apparatus housing, an inner gripping unit that is provided at an inner side of the respective one of both side walls of the container body in the width direction in an attachment and detachment operation side surface of the container body, the inner gripping unit being able to be gripped together with the outer gripping unit, and a cover that projects in an eave shape laterally from a respective one of both sides of the attachment and detachment operation side surface of the container body in the width direction, the cover covering the gap between the respective one of both side walls of the container body in the width direction and a projecting end of the outer gripping unit when viewed from the attachment and detachment operation side.

2. The detachable container according to claim 1, wherein in each operation unit, the cover has an overlapping portion that faces the projecting end of the outer gripping unit when viewed from the attachment and detachment operation side of the container body.

3. The detachable container according to claim 1, wherein in each operation unit, the projecting end of the outer gripping unit is exposed laterally from the cover when viewed from the attachment and detachment operation side of the container body.

4. The detachable container according to claim 2, wherein in each operation unit, the projecting end of the outer gripping unit is exposed laterally from the cover when viewed from the attachment and detachment operation side of the container body.

5. The detachable container according to claim 1, wherein in each operation unit, the cover has a minute gap of 1 mm or less between the cover and the projecting end of the outer gripping unit.

6. The detachable container according to claim 2, wherein in each operation unit, the cover has a minute gap of 1 mm or less between the cover and the projecting end of the outer gripping unit.

7. The detachable container according to claim 3, wherein in each operation unit, the cover has a minute gap of 1 mm or less between the cover and the projecting end of the outer gripping unit.

8. The detachable container according to claim 4, wherein in each operation unit, the cover has a minute gap of 1 mm or less between the cover and the projecting end of the outer gripping unit.

9. The detachable container according to claim 1, wherein in each operation unit, a vertical width dimension of the cover is longer than a vertical width dimension of the outer gripping unit.

10. The detachable container according to claim 2, wherein in each operation unit, a vertical width dimension of the cover is longer than a vertical width dimension of the outer gripping unit.

11. The detachable container according to claim 9, wherein in each operation unit, the cover has bent portions that are bent toward the gap, at upper and lower ends of the cover.

12. The detachable container according to claim 9, wherein each cover has a lateral bent portion at a projecting end of the cover, the lateral bent portion being bent toward the gap, the projecting end of each cover projecting laterally from the respective one of both side walls of the container body in the width direction, and in each operation unit, the lateral bent portion has a notch that follows a shape of the projecting end of the outer gripping unit.

13. The detachable container according to claim 1, wherein in each operation unit, the outer gripping unit has a flange at a projecting end of a gripping body of the outer gripping unit, the flange being bent outward.

14. The detachable container according to claim 13 wherein in each operation unit, the flange has extension portions that extend toward the gripping body, at upper and lower ends of the flange.

15. The detachable container according to claim 1, wherein in each operation unit, the outer gripping unit includes an anti-slip portion on an outer surface of a gripping body.

16. The detachable container according to claim 1, wherein in each operation unit, the inner gripping unit is a recess formed in the attachment and detachment operation side surface of the container body.

17. The detachable container according to claim 16, wherein in each operation unit, the recess that serves as the inner gripping unit has a vertical width dimension shorter than a vertical width dimension of the outer gripping unit, and is biased to a vicinity of an upper portion of the outer gripping unit.

18. The detachable container according to claim 16, wherein in each operation unit, the recess that serves as the inner gripping unit has a hollow in an inner wall of the recess disposed close to the outer gripping unit.

19. A container mounting apparatus comprising:

an apparatus housing; and the detachable container according to claim 1 that is detachably mounted in a receiving portion of the apparatus housing.

20. The container mounting apparatus according to claim 19, wherein the detachable container includes a restraining unit that restrains the detachable container from being detached from the receiving portion of the apparatus housing when the detachable container is mounted in the receiving portion of the apparatus housing.

* * * * *